US005462170A

United States Patent [19]

Colgate

[11] Patent Number: 5,462,170

[45] Date of Patent: Oct. 31, 1995

[54] AUTOGRAPH BUTTON COVER

[76] Inventor: George S. Colgate, 3124 19th Street Rd., Greeley, Colo. 80631

[21] Appl. No.: 305,595

[22] Filed: Sep. 14, 1994

[51] Int. Cl.[6] ..... B65D 85/58; A44B 1/04; A44B 1/14

[52] U.S. Cl. ..... 206/574; 24/113 MP; 206/38; 206/224; 206/232

[58] Field of Search ..... 24/90 R, 92, 113 MP, 24/113 R; 150/154; 206/37, 38, 223, 224, 232, 459.5, 574, 575; 244/101, 182

[56] References Cited

U.S. PATENT DOCUMENTS

| | | | |
|---|---|---|---|
| 2,067,814 | 1/1937 | Bangs | 24/118 MP |
| 3,214,811 | 11/1965 | Adinolfi | 24/113 R |
| 4,580,320 | 4/1986 | Takata | 24/113 R |
| 5,000,327 | 3/1991 | Kincheloe | 206/232 |
| 5,025,920 | 6/1991 | Walsh et al. | 206/223 |
| 5,195,220 | 3/1993 | Herman | 24/113 MP |

FOREIGN PATENT DOCUMENTS

| | | | |
|---|---|---|---|
| 2421575 | 12/1979 | France | 24/113 MP |
| 296164 | 1/1917 | Germany | 24/113 MP |
| 2211345 | 9/1973 | Germany | 24/113 MP |

*Primary Examiner*—Jimmy G. Foster

[57] ABSTRACT

An autograph button cover system comprising a button cover formed of a transparent elastomeric material having a circular upper surface with a cylindrical side wall extending at right angles from the upper surface and with an in-turned circular flange with an aperture extending therethrough; and a cylindrical button adapted to receive the cover, the button being of a size so as to have its exterior cylindrical periphery located in contact with the interior surface of the side wall of the cover.

7 Claims, 4 Drawing Sheets

AUTOGRAPH BUTTON COVER

BACKGROUND OF THE INVENTION

1. Field of the Invention

The present invention relates to an autograph button cover and more particularly pertains to decorating buttons and pop-it beads with autograph covers for a decorative affect and a demonstration of popularity.

2. Description of the Prior Art

The use of a decorative effect for apparel of a wide variety of designs and configurations is known in the prior art. More specifically, a decorative effect for apparel of a wide variety of designs and configurations heretofore devised and utilized for the purpose of decorate one's apparel through techniques, devices, fads and the like are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,175,911 to Terrels a snap fastener.

U.S. Pat. No. 5,101,541 to Watanabe discloses a snap button.

U.S. Pat. No. 4,662,034 to Cunningham discloses a snap-on button.

U.S. Pat. No. 4,481,696 to Kanzaka discloses a snap-it button.

U.S. Pat. No. 3,479,703 to Embry discloses a snap-on button.

In this respect, the autograph button cover according to the present invention substantially departs from the conventional concepts and designs of the prior art, and in doing so provides an apparatus primarily developed for the purpose of decorating buttons and pop-it beads with autograph covers for a decorative affect and a demonstration of popularity.

Therefore, it can be appreciated that there exists a continuing need for a new and improved autograph button cover which can be used for decorating buttons and pop-it beads with autograph covers for a decorative affect and a demonstration of popularity. In this regard, the present invention substantially fulfills this need.

SUMMARY OF THE INVENTION

In view of the foregoing disadvantages inherent in the known types of decorative effects for apparel of a wide variety of designs and configurations now present in the prior art, the present invention provides an improved autograph button cover. As such, the general purpose of the present invention, which will be described subsequently in greater detail, is to provide a new and improved autograph button cover and method which has all the advantages of the prior art and none of the disadvantages.

To attain this, the present invention essentially comprises a new and improved autograph button cover assembly comprising, in combination, a button cover formed of a transparent elastomeric material having a circular upper surface with a cylindrical side wall extending at right angles from the upper surface and with an in-turned circular flange with an aperture extending therethrough; a cylindrical button adapted to receive the cover, the button being of a size so as to have its exterior cylindrical periphery located in contact with the interior surface of the side wall of the cover, the button also having apertures therethrough for stitching to a piece of apparel; a pen with indelible ink therein adapted for signing the cylindrical surface of the cover; and a box having a first zone for the storage of covers, a second zone for the receipt of an instructional booklet on the method of use and a third zone for the receipt of the pen.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved autograph button cover which has all the advantages of the prior art decorative effects for apparel of a wide variety of designs and configurations and none of the disadvantages.

It is another object of the present invention to provide a new and improved autograph button cover which may be easily and efficiently manufactured and marketed.

It is further object of the present invention to provide a new and improved autograph button cover which is of durable and reliable constructions.

An even further object of the present invention is to provide a new and improved autograph button cover which is susceptible of a low cost of manufacture with regard to both materials and labor, and which accordingly is then susceptible of low prices of sale to the consuming public, thereby making such autograph button cover economically available to the buying public.

Still yet another object of the present invention is to provide a new and improved autograph button cover which provides in the apparatuses and methods of the prior art some of the advantages thereof, while simultaneously overcoming some of the disadvantages normally associated therewith.

Still another object of the present invention is to decorate buttons and pop-it beads with autograph covers for a decorative effect and a demonstration of popularity.

Lastly, it is an object of the present invention to provide a new and improved autograph button cover system comprising a button cover formed of a transparent elastomeric material having a circular upper surface with a cylindrical side wall extending at right angles from the upper surface and with an in-turned circular flange with an aperture extending therethrough; and a cylindrical button adapted to receive the cover, the button being of a size so as to have its exterior cylindrical periphery located in contact with the interior surface of the side wall of the cover.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1A:
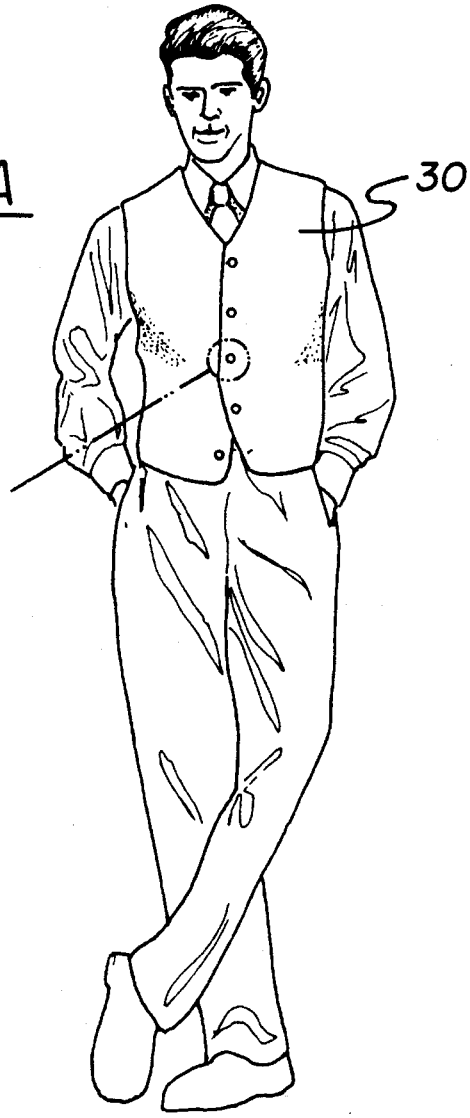
FIG. 1 is a perspective view of the preferred embodiment of the autograph button cover constructed in accordance with the principles of the present invention.
Figure 1B:
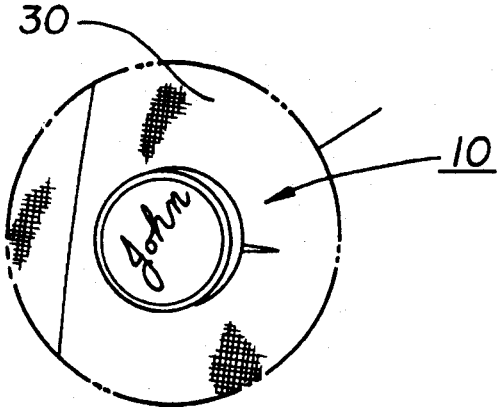
Figure 2:
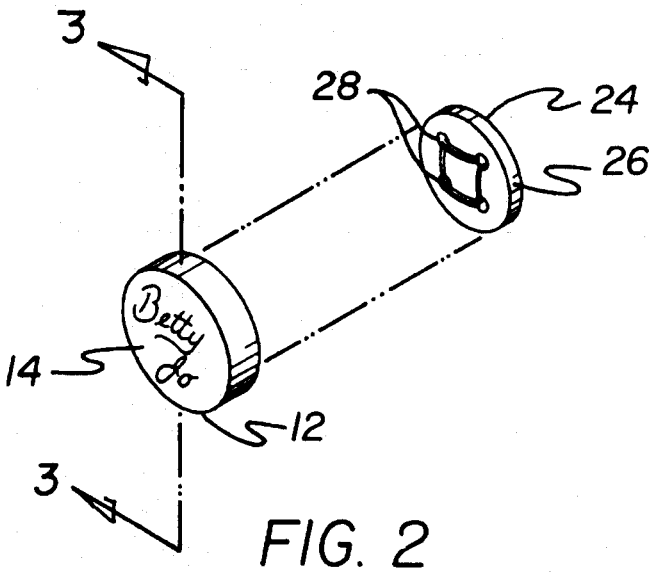
FIG. 2 is an enlarged exploded perspective view of the device shown in FIG. 1.
Figure 3:
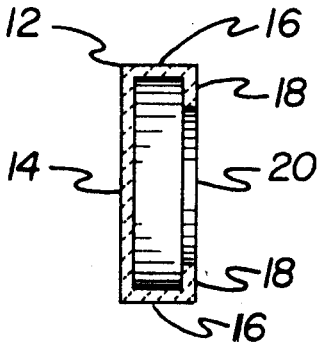
FIG. 3 is a cross sectional view through the button cover of FIGS. 1 and 2.
Figure 4A:
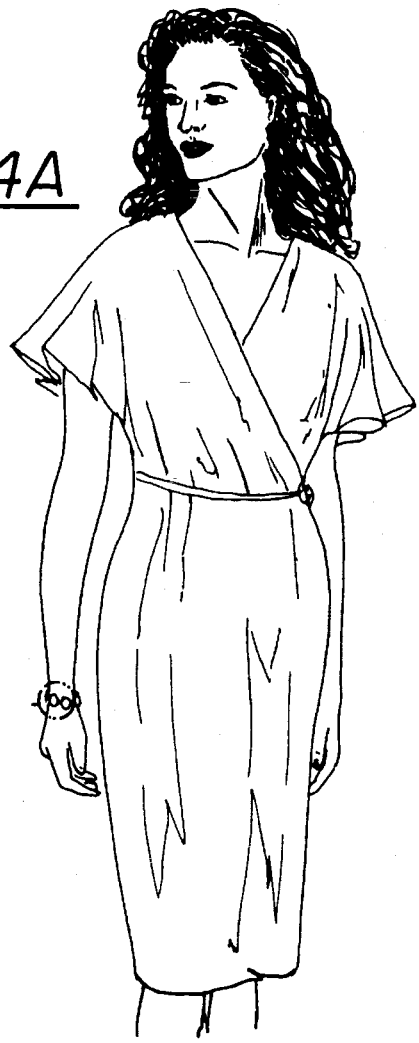
FIG. 4 is a perspective view of the button cover as applied to pop-it beads.
Figure 4B:
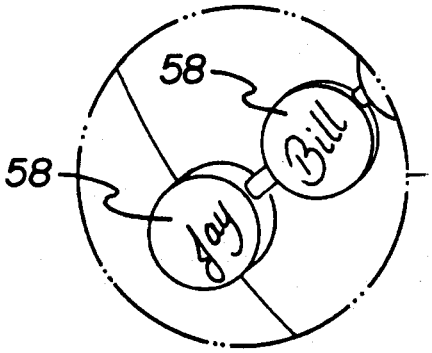
Figure 5:
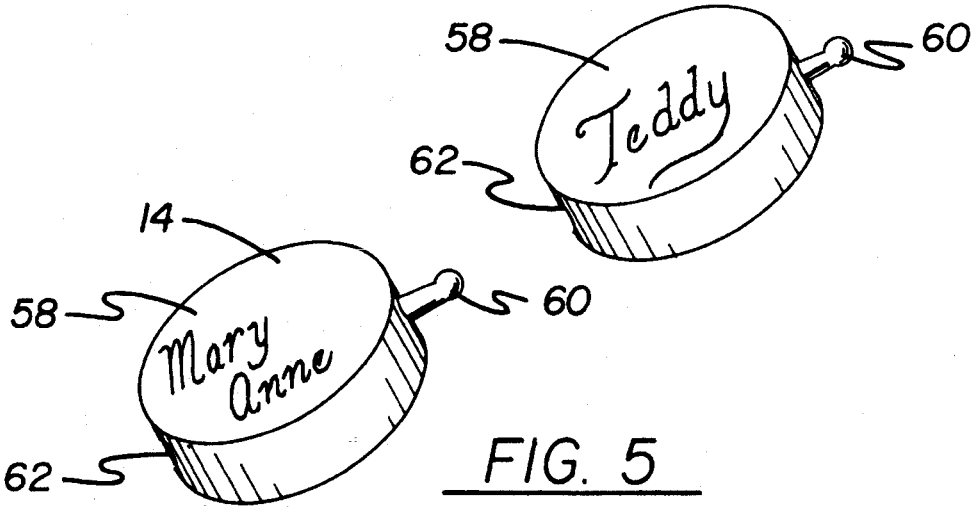
FIG. 5 is an exploded perspective view of the device shown in the circle of FIG. 4.
Figure 6:
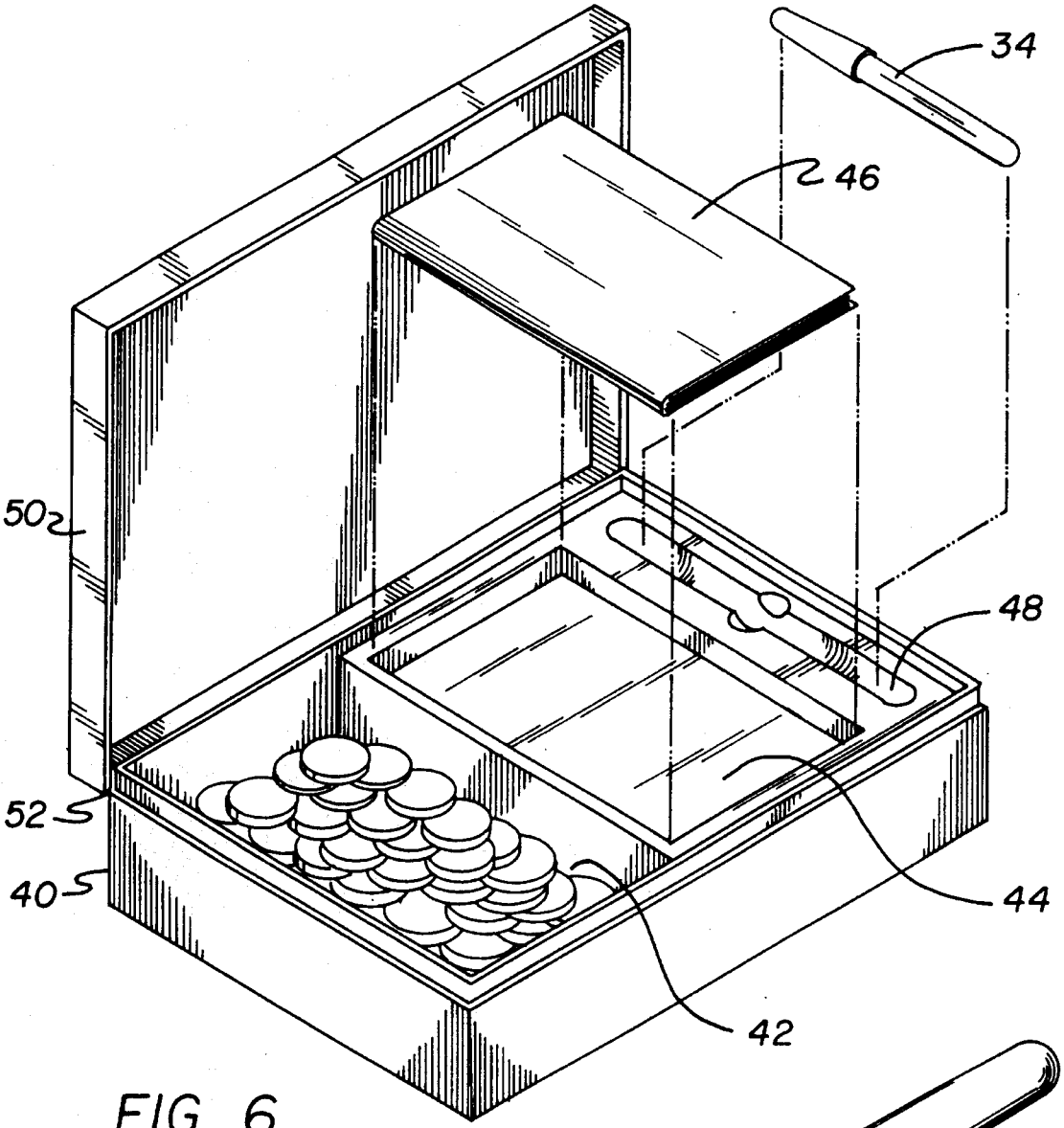
FIG. 6 is a device for storing button covers including an accompanying pen and book of directions.
Figure 7:
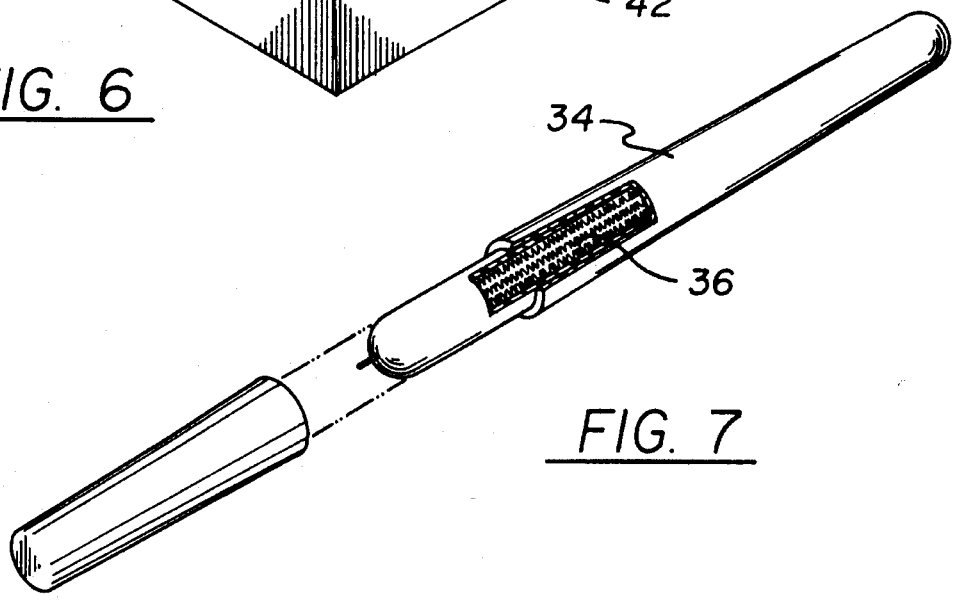
FIG. 7 is an exploded perspective of the pen of FIG. 6 with parts broken away to show certain internal constructions thereof.
Figure 9:
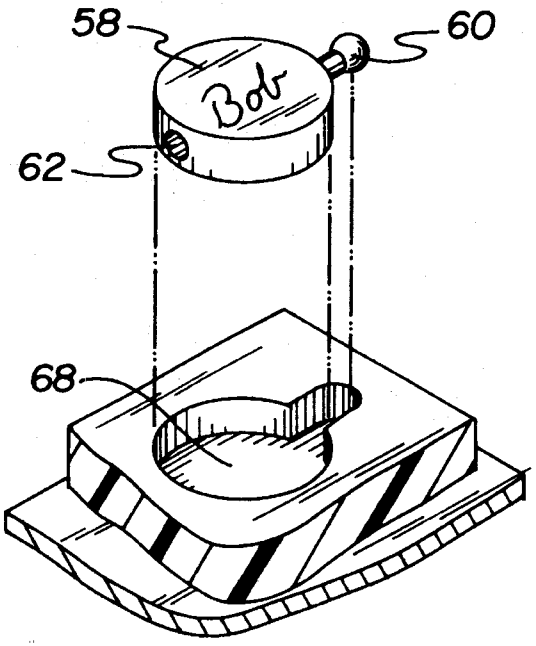
FIG. 9 is an exploded perspective view of a device for storing a pop-it with the button cover of the prior Figures.

With reference now to the drawings, and in particular to FIG. 1 thereof, the preferred embodiment of the new and improved autograph button cover embodying the principles and concepts of the present invention and generally designated by the reference numeral 10 will be described.

The present invention, the new and improved autograph button cover is comprised of a plurality of component elements. Such component elements in their broadest context, include the button cover, the button, a pen, a box and an album. Such components are individually configured and correlated with respect to each other so as to attain the desired objectives.

The central component of the system is a button cover assembly 10. Such button cover assembly includes a button 12 formed of a transparent elastomeric material. The cover has a circular upper surface 14. It also has a cylindrical side wall 16 extending downwardly at right angles from the upper surface. Also, the button cover has an in-turned circular flange 18 with an aperture 20 extending therethrough for a purpose as will be described hereinafter.

The assembly also includes the cylindrical button 24. Such button is adapted to receive the cover 12. The button is of a size to have its exterior cylindrical periphery 26 located in contact with the interior surface of the side wall of the cover. The button also has apertures 28 therethrough for stitching to a piece of apparel 30 in the conventional manner.

Usable in association with the button and button cover is a pen 34. The pen is provided with an indelible ink 36 located within the body of the pen. The ink is adapted for use in signed the cylindrical surface of the cover.

Lastly, the assembly includes a box 40. The box is rectangular in configuration and is formed with a first zone 42 for the storage of a plurality of covers. A second zone 44 laterally offset from the first zone is provided for the receipt of an instructional booklet 46 on the method of use of the assembly. A third zone 48 is provided for the receipt of the pen. The third zone is located on the side of the second zone opposite from the first zone. A lid 50 is coupled as through a hinge 52 for closing the lid of the box 40.

Figure 8:
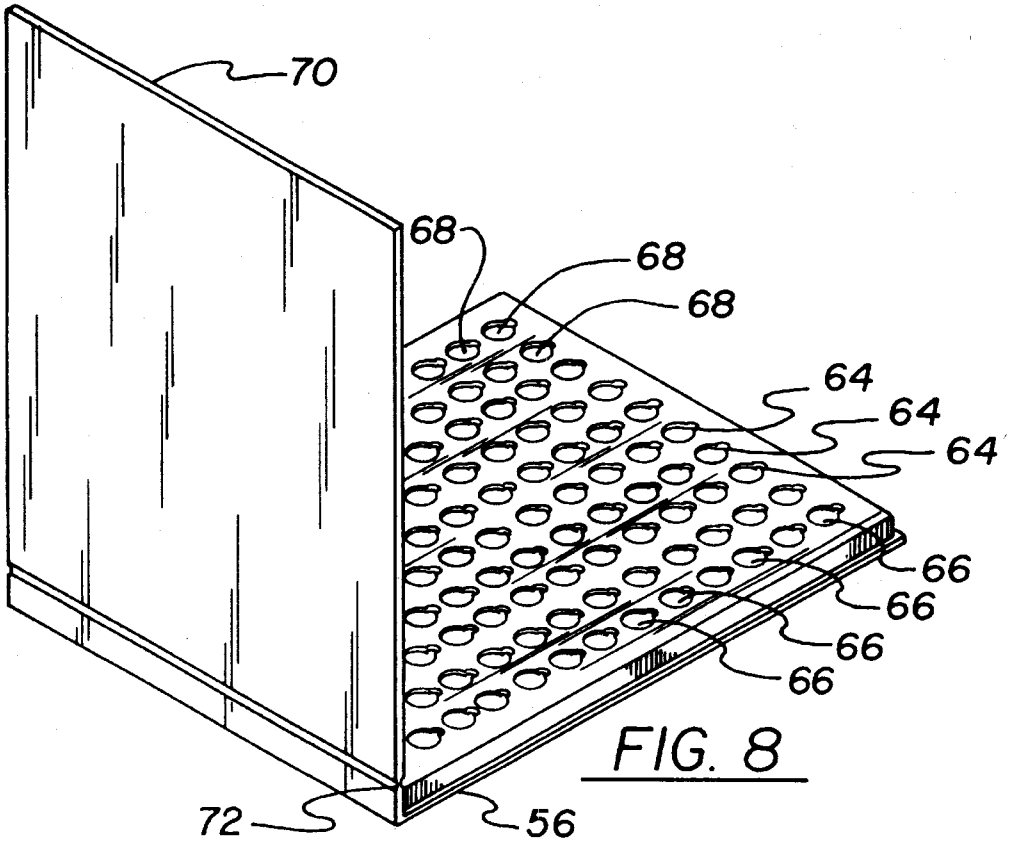
FIG. 8 is a collector's book for storing the pop-it beads with covers as shown in the prior Figures.

One additional component of the assembly is an album 56. The album in association with the assembly may be considered a system. The album is for the receipt and storage of covers as described above. It is also adapted for the receipt of pop-its 58. Pop-its are members which may be coupled one to another through projections 60 and recesses 62 to form a chain of jewelry. Such arrangements are well known in the arts and may be considered conventional. The album is provided with a plurality of rows 64 and columns 66 of recesses 68 for the receipt of covers and pop-its. In addition, a lid 70 with a hinge 72 is provided for selectively covering the container and for allowing the opening and closing of the lid over the container between an operative open position as shown in FIG. 8 and an inoperative closed position for storage and transportation.

The present invention comprises a unique, tradable button cover for older, school-aged children which displays personally designed autographs imprinted on the outer surface.

The present invention is ⅜inch in diameter, the size of a standard button. It is manufactured from a lightweight, plastic material which easily stretches on and off the button. A pen and rubber marking ink, similar to that used on balloons, are included with the button cover kit. The covers can be purchased in two styles: a single button cover, which is displayed individually over clothing buttons, and one which features a "pop bead" design which allows other button covers to be snapped on, forming a chain. The button cover kit has complete easy-to-follow instructions and a number of covers that can be autographed. In addition, these covers could be purchased in a variety of colors for distinctive designs.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved autograph button cover assembly comprising, in combination:

a button cover formed of a transparent elastomeric material having a circular upper surface with a cylindrical side wall extending at right angles from the upper surface and with an in-turned circular flange with an aperture extending therethrough;

a cylindrical button adapted to receive the cover, the button being of a size so as to have its exterior cylindrical periphery located in contact with the interior surface of the side wall of the cover, the button also having apertures therethrough for stitching to a piece of apparel;

a pen with indelible ink therein adapted for signing the cylindrical surface of the cover; and a box having a first zone for the storage of covers, a second zone for the receipt of an instructional booklet on the method of use and a third zone for the receipt of the pen.

2. An autograph button cover system comprising:

a button cover formed of a transparent elastomeric material having a circular upper surface with a cylindrical side wall extending at right angles from the upper surface and with an in-turned circular flange with an aperture extending therethrough; and a cylindrical button adapted to receive the cover, the button being of a size so as to have its exterior cylindrical periphery located in contact with the interior surface of the side wall of the cover.

3. The system as set forth in claim 2 wherein the button also has apertures therethrough for stitching to a piece of apparel.

4. The system as set forth in claim 2 wherein the button also has a projection on one side and a recess on the other for coupling with like buttons to form a string of pop-it jewelry.

5. The system as set forth in claim 2 and further including:

a pen with indelible ink therein adapted for signing the cylindrical surface of the cover.

6. The system as set forth in claim 2 and further including:

a box having a first zone for the storage of covers, a second zone for the receipt of an instructional booklet on the method of use and a third zone for the receipt of the pen.

7. The system as set forth in claim 4 and further including:

an album for the receipt and storage of covers and pop-its having a plurality of rows and columns of recesses for the receipt of covers and pop-its and a cover for covering the container with a hinge for coupling the cover and the container.

* * * * *